US005164131A

United States Patent [19]

Chau et al.

[11] Patent Number: 5,164,131

[45] Date of Patent: Nov. 17, 1992

[54] METHODS FOR SYNTHESIZING PULPS AND SHORT FIBERS CONTAINING POLYBENZAZOLE POLYMERS

[75] Inventors: Chieh-Chun Chau, Midland, Mich.; Ritchie A. Wessling, Berkeley, Calif.

[73] Assignee: The Dow Chemical Company, Midland, Mich.

[21] Appl. No.: 584,813

[22] Filed: Sep. 19, 1990

[51] Int. Cl.[5] ..... D01F 6/74

[52] U.S. Cl. ..... 264/28; 264/143; 264/148; 264/184; 264/211.15; 264/211.16

[58] Field of Search ..... 264/28, 143, 141, 148, 264/184, 211.14, 211.15, 211.16

[56] References Cited

U.S. PATENT DOCUMENTS

| | | | |
|---|---|---|---|
| 2,347,464 | 4/1944 | Cuno | 241/DIG. 14 |
| 3,480,456 | 11/1969 | Forkner | 427/4 |
| 3,921,874 | 11/1975 | Spain | 225/4 |
| 4,127,625 | 11/1978 | Arisaka et al. | 264/49 |
| 4,278,623 | 7/1981 | Nigisch | 264/28 |
| 4,324,706 | 4/1982 | Tobe et al. | 523/49 |
| 4,359,567 | 11/1982 | Evers | 528/185 |
| 4,426,470 | 1/1984 | Wessling | 524/35 |
| 4,533,692 | 8/1985 | Wolfe et al. | 524/417 |
| 4,533,693 | 8/1985 | Wolfe et al. | 524/417 |
| 4,533,724 | 8/1985 | Wolfe et al. | 528/313 |
| 4,550,131 | 10/1985 | Kato | 524/35 |
| 4,578,432 | 3/1986 | Tsai et al. | 528/184 |
| 4,703,103 | 10/1987 | Wolfe et al. | 528/179 |
| 4,836,507 | 6/1989 | Yang | 264/143 |
| 4,846,408 | 7/1989 | Sallavanti et al. | 241/18 |
| 4,884,753 | 12/1989 | Maki | 241/3 |

*Primary Examiner*—Hubert C. Lorin

[57] ABSTRACT

Pulps and short fibers containing polybenzoxazole and/or polybenzothiazole or copolymers thereof can be synthesized by freezing the wet fiber straight from the coagulation bath without drying, and chopping or grinding the frozen fiber to the desired size and degree of fibrillation.

10 Claims, No Drawings

METHODS FOR SYNTHESIZING PULPS AND SHORT FIBERS CONTAINING POLYBENZAZOLE POLYMERS

BACKGROUND OF THE INVENTION

This invention relates to polybenzoxazole and polybenzothiazole fibers.

Polybenzoxazole and polybenzothiazole polymers are known polymers which are noted for their high tensile strength and modulus. The polymers, methods to synthesize them and methods to spin them into fibers are described in detail in numerous references, such as the following, which are incorporated herein by reference: Wolfe et al., *Liquid Crystalline Polymer Compositions, Process and Products*, U.S. Pat. No. 4,703,103 (Oct. 27, 1987); Wolfe et al., *Liquid Crystalline Polymer Compositions, Process and Products*, U.S. Pat. No. 4,533,692 (Aug. 6, 1985); Wolfe et al., *Liquid Crystalline Poly(2,6-Benzothiazole) Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermoxadatively Stable Articulated p-Benzobisoxazole and p-Benzobisthiazole Polymers*, U.S. Pat. No. 4,359,567 (Nov. 16, 1982); Tsai et al., *Method for Making Heterocyclic Block Copolymer*, U.S. Pat. No. 4,578,432 (Mar. 25, 1986); 11 Ency. Poly. Sci. & Eng., *Polybenzothiazoles and Polybenzoxazoles*, 601 (J. Wiley & Sons 1988) and W. W. Adams et al., *The Materials Science and Engineering of Rigid-Rod Polymers* (Materials Research Society 1989).

It is known that the polymers can be made into fibers and films which are useful in composites and laminates. It would be useful to make other forms of shaped articles containing polybenzazole polymer that are useful for other purposes.

SUMMARY OF THE INVENTION

One aspect of the present invention is a process for synthesizing short fibers or pulps containing polybenzoxazole or polybenzothiazole comprising the steps of:

1) spinning a fiber from a spinnable dope containing a polybenzoxazole or polybenzothiazole polymer or copolymer and a solvent acid;
2) coagulating the dope in a freezable liquid that is not a solvent for the polymer or copolymer to form a coagulated fiber;
3) freezing the coagulated fiber which contains the polymer or copolymer and the freezable non-solvent liquid;
4) mechanically reducing the frozen fiber to a short fiber or pulp having a chosen average length and level of fibrillation; and
5) warming the frozen fibers to a temperature at which they can be used or dried.

A second aspect of the present invention is a pulp containing polybenzoxazole or polybenzothiazole or a copolymer thereof having an average fibrillar length of at most about ½ in. and an average fibrillar diameter of at most about 10 μm.

A third aspect of the present invention is a short fiber, containing polybenzoxazole or polybenzothiazole or a copolymer thereof, that has an average fiber length of no more than about ½ in. and is essentially unfibrillated, except at the ends.

The process of the present invention can be used to make short fibers and pulps of the present invention, which are useful in composites, papers and abrasion resistant materials.

DETAILED DESCRIPTION OF THE INVENTION

The present invention uses fibers that contain polybenzoxazole (PBO) or polybenzothiazole (PBT) or copolymers thereof. PBO, PBT and random, sequential and block copolymers of PBO and PBT are described in references such as Wolfe et al., *Liquid Crystalline Polymer Compositions, Process and Products*, U.S. Pat. No. 4,703,103 (Oct. 27, 1987); Wolfe et al., *Liquid Crystalline Polymer Compositions, Process and Products*, U.S. Pat. No. 4,533,692 (Aug. 6, 1985); Wolfe et al., *Liquid Crystalline Poly(2,6-Benzothiazole) Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermoxadatively Stable Articulated p-Benzobisoxazole and p-Benzobisthiazole Polymers*, U.S. Pat. No. 4,359,567 (Nov. 16, 1982); Tsai et al., *Method for Making Heterocyclic Block Copolymer*, U.S. Pat. No. 4,578,432 (Mar. 25, 1986); 11 Ency. Poly. Sci. & Eng., *Polybenzothiazoles and Polybenzoxazoles*, 601 (J. Wiley & Sons 1988) and W. W. Adams et al., *The Materials Science and Engineering of Rigid-Rod Polymers* (Materials Research Society 1989), which are incorporated herein by reference.

The polymer may contain AB-mer units, as represented in Formula 1(a), and/or AA/BB-mer units, as represented in Formula 1(b)

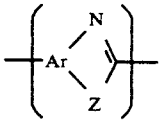

1(a) AB

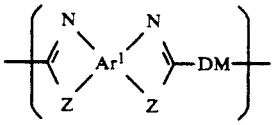

1(b) AA/BB wherein:

Each Ar represents an aromatic group. The aromatic group may be heterocyclic, such as a pyridinylene group, but it is preferably carbocyclic. The aromatic group may be a fused or unfused polycyclic system, but is preferably a single six-membered ring. Size is not critical, but the aromatic group preferably contains no more than about 18 carbon atoms, more preferably no more than about 12 carbon atoms and most preferably no more than about 6 carbon atoms. Examples of suitable aromatic groups include phenylene moieties, tolylene moieties, biphenylene moieties and bis-phenylene ether moieties.

Each Z is independently an oxygen or a sulfur atom.

Each DM is independently a bond or a divalent organic moiety that does not interfere with the synthesis, fabrication or use of the polymer. The divalent organic moiety may contain an aliphatic group, which preferably has no more than about 12 carbon atoms, but the divalent organic moiety is preferably an aromatic group (Ar) as previously described.

The nitrogen atom and the Z moiety in each azole ring are bonded to adjacent carbon atoms in the aromatic group, such that a five-membered azole ring fused with the aromatic group is formed.

The azole rings in AA/BB-mer units may be in cis- or trans-position with respect to each other, as illustrated in 11 Ency. Poly. Sci. & Eng., supra, at 602, which is incorporated herein by reference.

The polymer preferably consists essentially of either AB-PBZ mer units or AA/BB-PBZ mer units, and more preferably consists essentially of AA/BB-PBZ mer units. The polybenzazole polymer may be rigid rod, semi-rigid rod or flexible coil. It is preferably rigid rod in the case of an AA/BB-PBZ polymer or semirigid in the case of an AB-PBZ polymer. Azole rings within the polymer are preferably oxazole rings (Z=O). Preferred mer units are illustrated in Formulae 2(a)-(e).

2

(a)

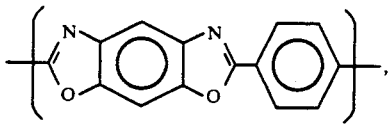

(b)

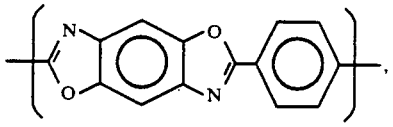

(c)

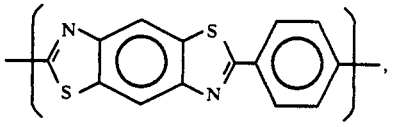

(d)

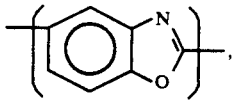

and (e)

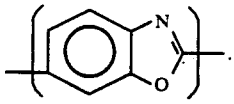

Each polymer preferably contains on average at least about 25 mer units, more preferably at least about 50 mer units and most preferably at least about 100 mer units.

The polymer may also be a random, sequential or block copolymer containing PBO or PBT mer units and mer units of other polymers, such as polyamide, polyimide, polyquinoxaline, polyquinoline or poly(aromatic ether ketone or sulfone) such copolymers are described in Harris et al., Copolymers Containing Polybenzoxazole, Polybenzothiazole and Polybenzimidazole Moieties, International Application No. PCT/US89/04464 (filed Oct. 6, 1989), International Publication No. WO 90/03995 (published Apr. 19, 1990), which is incorporated herein by reference.

The polymers are spun into fibers from spinnable dopes containing polymer dissolved in a solvent acid, which is preferably polyphosphoric acid and/or methanesulfonic acid. The dope should contain a sufficient amount of fiber to be spinnable to form fibers. The optimum concentration may vary widely depending upon the polymer in the dope and its average molecular weight. In most cases, the dope preferably contains at least about 2 percent polymer and more preferably at least about 4 percent polymer.

When the dope contains a rigid rod polybenzoxazole or polybenzothiazole having an intrinsic viscosity of at least 20 dL/g at about 25° C. in methanesulfonic acid (preferably saturated with methanesulfonic acid anhydride), the concentration of polymer in the dope is highly preferably at least about 10 weight percent, more highly preferably at least about 12 weight percent and most preferably at least about 15 weight percent. When the dope contains a rigid rod polybenzoxazole or polybenzothiazole having an intrinsic viscosity in methanesulfonic acid of at least 20 dL/g, the maximum concentration of polymer in the dope is limited primarily by practical considerations, such as solubility and viscosity. The concentration is ordinarily less than about 20 percent and preferably no more than about 17 percent.

The dope is spun to form a fiber by a dry jet-wet spinning process. Such processes are described in Chenevey et al, "Formation and Properties of Fiber and Film from PBZT," *The Materials Science and Engineering of Rigid-Rod Polymers* 245 (Materials Research Society 1989); and Ledbetter et al., "An Integrated Laboratory Process for Preparing Rigid Rod Fibers from Monomers," *The Materials Science and Engineering of Rigid-Rod Polymers* 253 (Materials Research Society 1989), which are incorporated herein by reference. The spun and drawn dope fiber is coagulated in a freezable liquid which dilutes the solvent acid and is a non-solvent for the polymer. The freezable non-solvent liquid may be organic, but it is preferably aqueous. Aqueous coagulants may be basic or mildly acidic, but are preferably about neutral, at least at the commencement of coagulation. The most preferred freezable non-solvent liquid is water.

It is important that the non-solvent used for coagulation be a freezable liquid that is suitable to freeze with the fibers for the next step of the process. The coagulated fiber has a relatively open structure containing the coagulant liquid. Once the fiber has been dried, it has very little water regain and can not be effectively rewetted, so that grinding of a fiber which has been dried and rewetted is much less effective. From the stand point of both convenience and effectiveness, it is important to keep the coagulated fiber wet and freeze it with the coagulating non-solvent without drying.

The wet fiber suitable for freezing contains the polymer or copolymer and the freezable liquid, as previously described. The weight ratio of freezable liquid to polymer is preferably at least about 10:90 and more preferably at least about 50:50. It is preferably at most about 95:5.

The wet fiber is frozen to a temperature at which it becomes brittle. For the purposes of this application, the term "freezing" refers broadly to any solidification by reduction in temperature, without regard to whether a crystalline structure or a glassy solid is formed. For fibers containing aqueous liquid, the temperature is preferably less than 0° C., more preferably at most about −100° C. and most preferably at most about −190° C. A convenient temperature is at about liquid nitrogen temperatures.

Once frozen, the fiber is mechanically reduced to a desired length and degree of fibrillation, such as by grinding, crushing, tearing, cutting and/or chopping. The preferred techniques vary depending upon whether short fibers or pulps are desired. To obtain a pulp, it is preferred to grind, tear or crush the fiber, so that extensive fibrillation occurs. Cryogenic grinding equipment is known and described in numerous references, such as U.S. Pat. Nos. 2,347,464; 3,480,456; 3,921,874; 4,846,408 and 4,884,753, which are incorporated herein by reference. To obtain a short fiber, it is preferred to scissor, chop or otherwise cut the fiber by a means such that little or no fibrillation occurs.

The short fiber or pulp may be returned to warmer temperatures, dried and used, for instance by impregnating with a matrix resin and curing to provide a composite.

The length of short fibers and fibrils within pulps is preferably no more than about ½ inch, more preferably no more than about ¼ inch and most preferably no more than about ⅛ inch. Pulps are preferably highly fibrillated. They preferably have an average fibrillar diameter of no more than 10 μm, more preferably no more than about 5 μm and most preferably of no more than 1 μm. Short fibers preferably have a diameter about the same as that of the original fiber. Their average diameter is preferably more than 10 μm and more preferably at least about 15 μm. Segments of the short fiber may be partially fibrillated, but the short fiber is preferably not substantially fibrillated and most preferably essentially unfibrillated, except at the ends.

The short fibers and pulps of the present invention are preferably substantially uniform. When the average length or width of a pulp or short fiber is limited as previously described, then preferably no more than about 20 percent of the short fibers or pulp fall outside that limit, more preferably no more than about 10 percent fall outside that limit, and most preferably no more than about 5 percent fall outside that limit. Among pulps, preferably no more than about 20 percent of the pulp is unfibrillated, more preferably no more than about 10 percent, and most preferably no more than about 5 percent. Among short fibers, preferably no more than about 20 percent of the fiber is fibrillated, more preferably no more than about 10 percent, and most preferably no more than about 5 percent.

The process and resulting fibers and pulps or the present invention have several advantages over processes and resulting pulps from simply chopping or grinding a dried fiber. Dried fibers are very difficult to cut or fibrillate. Therefore, attempts to cut them cause excessive wear on grinding and cutting equipment and ordinarily yield to very inconsistent quality cut fibers or pulp, containing irregular lengths of fiber, some of which is highly fibrillated and some of which is essentially unfibrillated. On the other hand, frozen wet fibers are more brittle. They cut, grind, crush and tear more easily without excessive wear to the equipment, and the resulting short fiber or pulp product is much more uniform. The degree of fibrillation can easily be selected from uniformly highly fibrillated to essentially unfibrillated or degrees of fibrillation inbetween by proper selection of the cutting or grinding or other technique.

The short fibers may be used in random fiber composites, as described in U.S. Pat. Nos. 4,426,470 and 4,550,131, which are incorporated herein by reference. Pulps may be used in non-woven sheets and abrasive materials, as described in U.S. Pat. No. 4,324,706, which is incorporated herein by reference.

ILLUSTRATIVE EXAMPLES

The following examples are given to illustrate the invention and should not be interpreted as limiting the Specification or the Claims. Unless stated otherwise, all parts and percentages are given by weight.

EXAMPLE 1

Preparation of PBO Pulp

A dope is obtained containing 87 percent polyphosphoric acid and 13 percent cis-polybenzoxazole (as illustrated in Formula 2(a)) having an inherent viscosity of about 34 dL/g at 25° C. and 0.05 g/dl concentration in methanesulfonic acid saturated with methanesulfonic acid anhydride. The dope is spun at 150° C. from a 10 mil 36 hole spindle with a spin-draw ratio of about 30 into a coagulation bath containing water. The fibers are kept immersed in water for about 24 hours and then scissored to lengths of about 1 to 2 inches while wet. The wet fibers are immersed in liquid nitrogen for about 1 minute. The frozen fiber is ground in a Retsch centrifugal grinder at 10,000 rpm using a 1.0 mesh screen (having openings of 1.8 mm × 1.2 mm). A small amount of liquid nitrogen is fed into the grinding chamber before and during grinding to keep the grinding chamber at an appropriate temperature. The ground fibers are warmed to room temperature and dried. They are pulps with a fibrillar diameter of about 1–5 μm.

EXAMPLE 2

Preparation of Random Short PBO Fibers

A dope as described in Example 1 is spun at 150° C. through a 3 mil spin die at a spin-draw ratio of 20 into a coagulation bath. The fibers are washed for 24 hours in running water and then kept under water until used further. The wet fibers are scissored into segments about 2 inches long and mixed with 50 cc of water. The mixture of water and fiber is frozen with liquid nitrogen and crushed with a hammer, stopping periodically to refreeze with liquid nitrogen. The crushed frozen product is heated to room temperature and dried. It is made up of short partially fibrillated fibers having a length of about 3/16 inch.

COMPARATIVE EXAMPLE A

A fiber is spun as described in Example 1. The spun fiber is heat treated at 500° C. under tension and then dried in air for 7 days.

Sample A-1 is ground as described in Example 1 without further processing. The fiber neither breaks nor fibrillates.

Sample A-2 is immersed in liquid nitrogen for one minute, then ground as described in Example 1. The fiber does not break but fibrillates a little.

Sample A-3 is immersed in water for 2 hours and immersed in liquid nitrogen for two minutes, then ground as described in Example 1. The resulting fiber is broken into sections with irregular lengths and extensively fibrillated.

What is claimed is:

1. A process for synthesizing cut fibers or pulps containing polybenzoxazole or polybenzothiazole comprising the steps of:

1) spinning a fiber from a spinnable dope containing a polybenzoxazole or polybenzothiazole polymer or copolymer and a solvent acid;
2) coagulating the dope in a freezable liquid that is not a solvent for the polymer or copolymer to form a coagulated fiber;
3) freezing the coagulated fiber which contains the polymer or copolymer and the freezable non-solvent liquid;
4) mechanically reducing the frozen fiber to a chosen average length and level of fibrillation; and
5) warming the frozen fibers to a temperature at which they can be used or dried.

2. The process of claim 1 wherein the freezable non-solvent liquid contains an organic liquid.

3. The process of claim 1 wherein the freezable non-solvent liquid contains water.

4. The process of claim 3 wherein the weight ratio of freezable non-solvent liquid to polymer in the coagulated fiber of step (3) is at least about 10:90.

5. The process of claim 3 wherein the weight ratio of freezable non-solvent liquid to polymer in the coagulated fiber of step (3) is at least about 50:50 and at most about 95:5.

6. The process of claim 3 wherein the non-solvent liquid is frozen at a temperature of no higher than about −100° C.

7. The process of claim 3 wherein the non-solvent liquid is frozen at a temperature of no higher than about −190° C.

8. The process of claim 3 wherein the frozen fiber is converted to a short fiber having an average length of no greater than about ½ inch and an average diameter about equivalent to the diameter of the coagulated fiber of step (3).

9. The process of claim 3 wherein the frozen fiber is converted to a pulp having an average fibrillar diameter of no greater than about 5 μm and an average fibrillar length of no greater than about ½ inch.

10. The process of claim 9 wherein the frozen fiber is converted to a pulp having an average fibrillar diameter of no greater than about 1 μm.

* * * * *